United States Patent [19]

Orosei

[11] Patent Number: 4,516,703

[45] Date of Patent: May 14, 1985

[54] APPARATUS FOR REVERSING HOSE

[75] Inventor: Mario Orosei, Reggio Emilia, Italy

[73] Assignee: Fadis S.p.A., Solbiate Arno, Italy

[21] Appl. No.: 587,213

[22] Filed: Mar. 7, 1984

[30] Foreign Application Priority Data

Mar. 9, 1983 [IT] Italy ..... 19972 A/83

[51] Int. Cl.[3] ..... D05B 21/00

[52] U.S. Cl. ..... 223/39; 112/262.2; 223/40; 223/42; 223/43

[58] Field of Search ..... 223/39, 42, 40, 41, 223/43; 112/262.2

[56] References Cited

U.S. PATENT DOCUMENTS

| | | | |
|---|---|---|---|
| 1,898,824 | 2/1933 | Forstall | 223/39 |
| 2,340,420 | 1/1944 | Newman | 223/40 |
| 2,702,544 | 2/1955 | Hanington | 223/40 X |
| 3,429,284 | 2/1969 | Bryan | 112/262.2 X |
| 3,467,289 | 9/1969 | Preston | 223/40 |
| 3,516,583 | 6/1970 | Petty | 223/39 |
| 4,440,329 | 4/1984 | Hodges | 223/43 |
| 4,460,111 | 7/1984 | Nakahira | 223/43 |

FOREIGN PATENT DOCUMENTS

| | | | |
|---|---|---|---|
| 1345376 | 1/1974 | United Kingdom | 223/39 |
| 639981 | 2/1979 | U.S.S.R. | 223/39 |

*Primary Examiner*—Louis K. Rimrodt

*Attorney, Agent, or Firm*—Karl F. Ross; Herbert Dubno

[57] ABSTRACT

Apparatus for reversing or turning hose inside out comprises a pair of contra-rotating rollers 3 and 4, resiliently urged towards each other to form a nip therebetween into which the hose is introduced from its closed or toe cap end by a pick-up and conveyor assembly and a rod or rounded blade member 5 arranged to be displaced through the nip to engage the closed end of the hose and carry it away from the rollers while the latter draw the hose about the rod or blade element to turn the hose inside out.

14 Claims, 4 Drawing Figures

APPARATUS FOR REVERSING HOSE

BACKGROUND OF THE INVENTION

1. Field of the Invention

This invention relates to apparatus for reversing hose or turning it inside out during the process of manufacture after the toe part has been stitched to form a seam in such a way that a closed end or "cap" is formed at the toe end of the hose, such known cap having the finishing seam substantially above the position occupied by the toes when the hose is worn on the foot.

It is known that hose is generally made by machines which are normally of an automatic type, whose last task is to stitch the toe part of the hose in a position located between the upper edge of the toe part of the hose and the edge of the instep part of the same hose so as to form said closed end cap.

This stitching operation is usually carried out when the hose is placed inside out on a sewing machine. It is therefore necessary for the hose to be reversed or turned inside out after the seam has been completed so that the subsequent operations of pressing and packaging may be carried out.

This operation may be carried out manually or, for instance, by means of suction pipes or reversing means equipped with rollers or other devices. However, these systems have various drawbacks and they all, in any case, require human labour, both for reversing the hose manually and for loading it on the appropriate machine.

2. Description of the Prior Art

There are known apparatuses for reversing or turning other articles inside out such as, for instance, previously brushed flour bags, as disclosed in German Patent No. DE83521 of Oct. 23, 1895 or for reversing neckties as disclosed in U.S. Pat. No. 2,340,420 of Feb. 1, 1944.

In the first of these patent specifications, the bag to be reversed is placed by hand on a first shape, having the same outline and dimensions as the bag, which is positioned on a horizontally moving carriage carrying a second shape identical to the first, but arranged in a symmetrical position, such carriage being moved by hand by two operators on opposite sides, one for placing the bag on the first shape and the other for removing the reversed bag from the second shape.

The bag placed on the first shape is brushed by a first pair of brushes and is then reversed on the second shape by a second pair of brushes. These machines would be unable to reverse hose which is closed at the toes, firstly because the hose may be of various sizes and the tubular parts of the heel and of the leg of such hose do not have uniform cross sections, whereas the shapes on the moving carriage must be of uniform sizes, corresponding to those of the bags to be cleaned and reversed, and secondly because the hose to be reversed is in the process of being manufactured and does not require cleaning. Additionally, the requirement for two manual operators to put the bag on the first shape and take it off the second shape would not be compatible with an automated hose manufacturing installation.

In the second of the previously mentioned patent specifications, the machine described is intended to reverse neckties which are open at both ends and have a much reduced tubular cross-section.

In this machine, the open end of a tie is placed by hand on a first tubular member on to which it is hooked by means of a gripper integral with a second tubular member.

The reversing operation can be carried out only if an operator moves manually a pair of rollers adhering to the tie to a level which is below that at which the tie is hooked, in such a way that said rollers may grip the outer face of the tie and drag it along the first element while it is manually displaced.

In this case too, there are considerable drawbacks caused by the need for the open end of the tie to be manually put on and hooked to a tubular element, for the supports to be subsequently moved to make it possible for the pair of contra-rotating rollers to go past the hooking point, and then for the support to be returned to the initial position.

However, such a machine could not be used for hosiery, because it would be impossible for hose, which is closed at one end, to be put on said tubular element, and equally, it would be impossible to hook it to the same element.

SUMMARY OF THE INVENTION

Because of the mentioned drawbacks in the known art and of the need to have automated hosiery manufacture, including the step of reversing hose after the toe cap has been stitched in a time compatible with those of the other manufacturing stages, the technical problem is solved by apparatus for reversing hose according to the present invention.

According to the present invention there is provided apparatus for turning hose inside out after a seaming operation to form a closed end in the hose comprising a pair of contra-rotatable rollers urged towards each other to form a nip therebetween, transport means engageable with said closed end of the hose and operable to prevent said closed end to said nip, a rod displaceable through said nip to engage said presented closed end, roller rotating means operable to contra-rotate said rollers in the sense to draw said presented closed end and said hose into said nip, rod displacing means operable in synchronism with said roller rotating means to enter said rod into said nip as said closed end is drawn into said nip and to advance said rod through said nip in engagement with said closed end to displace said closed end away from said rollers as said rollers continue to draw said hose into said nip and about said rod.

The invention also provides a pick-up and conveyor assembly equipped with locking jaws arranged to feed the hose to be reversed to a pair of horizontal rollers, contra-rotating at possibly different speeds and resiliently urged towards one another, between which there can be inserted an element having a rod or blade or a similar member able to move vertically, the free end of such element coming into contact with the toe cap end of the hose and being retained and guided between said horizontal rollers in such a way that it can be inserted in the toe itself, a take off assembly equipped with rollers being provided at the end of the journey of said blade element in order to extract the already reversed hose from the moving blade, to complete the reversing operation when required and finally to send the hose to a collection point.

Such a pick up and conveyor assembly is located above the horizontal rollers, and provision is made for suitable means to guide the hose in descending between the rollers, especially in order to avoid the rod or blade element becoming entangled in the heel or other parts of the hose.

Such a rod or blade element is extended between the nip of the rollers during an ascending movement, that is to say a movement perpendicular to the plane containing the axes of the rollers, such movement being controlled by a rack connected thereto and connected to a cog wheel keyed to the same shaft as one of said horizontal rollers. Above the rollers there are provided jets of air directed towards the toe cap of the hose when it is in the process of being transferred from such a pick-up and conveyor assembly to the rollers, and further jets of air are provided below the rollers to open or form a depression in the toe cap of the hose to make it easy for the rod or blade to properly engage the hose. According to a preferred embodiment, the pick-up and conveyor assembly comprises a pair of jaws sliding by means of an actuator through horizontal guiding bars, between a pick-up position over a sewing machine or similar apparatus to a release position above said horizontal rollers, such jaws being operated by resilient means, as, in both the pick-up and release operations, there are present support elements operating in contrast with said resilient means to make the jaws open.

The means to guide the descent of the hose between the rollers consists of a horizontal bar above the rollers which can move along a guide shaped in a certain way, according to the rotation of the rollers and the motion of said blade element during the hose reversing operation.

The assembly for removing the hose from the blade element comprises a pair of rotating rollers resiliently pressed one against the other, between which there is inserted a blade element carrying the reversed hose at the upper end of its run, such rollers being made to rotate in opposite directions throughout the return or descent movement of the blade element so that the hose is removed by the friction of the blade and is made to drop into a container in which it is collected. Additionally, a short distance below the rotating rollers of assembly for removing hose, a pair of friction elements is provided on either side of the blade element, said friction elements acting resiliently against the face of the hose pulled over the blade element in order to complete the reversal of the end part of the hose by friction, if required, when it is taken off.

More specifically, the invention provides apparatus for turning hose inside out after a seaming operation to form a closed toe cap end on the hose comprising a pair of jaws displaceable relative to each other to engage said closed toe cap end of the hose and support the hose, transporting means for transporting the jaws with the engaged toe cap end to a hose reversing station, a pair of contra-rotatable rollers disposed below said hose reversing station, and urged towards each other to provide a nip therebetween, a rod disposed below the nip of said rollers and displaceable through the nip between said rollers, release means operable to displace said jaws apart at said hose reversing station to release said toe cap end to the nip between said rollers, displacing means operable to displace said rod through the nip between said rollers to engage said released toe cap end, driving means for rotating said rollers to draw said hose into said nip in a direction opposite to the direction of displacement of said rod through the nip between said rollers whereby the displacement of the rod with the engaged toe cap end turns the hose inside out and means for engaging and supporting the hose turned inside out when the rod is withdrawn through the nip between said rollers.

DETAILED DESCRIPTION OF THE DRAWINGS

Figure 1:
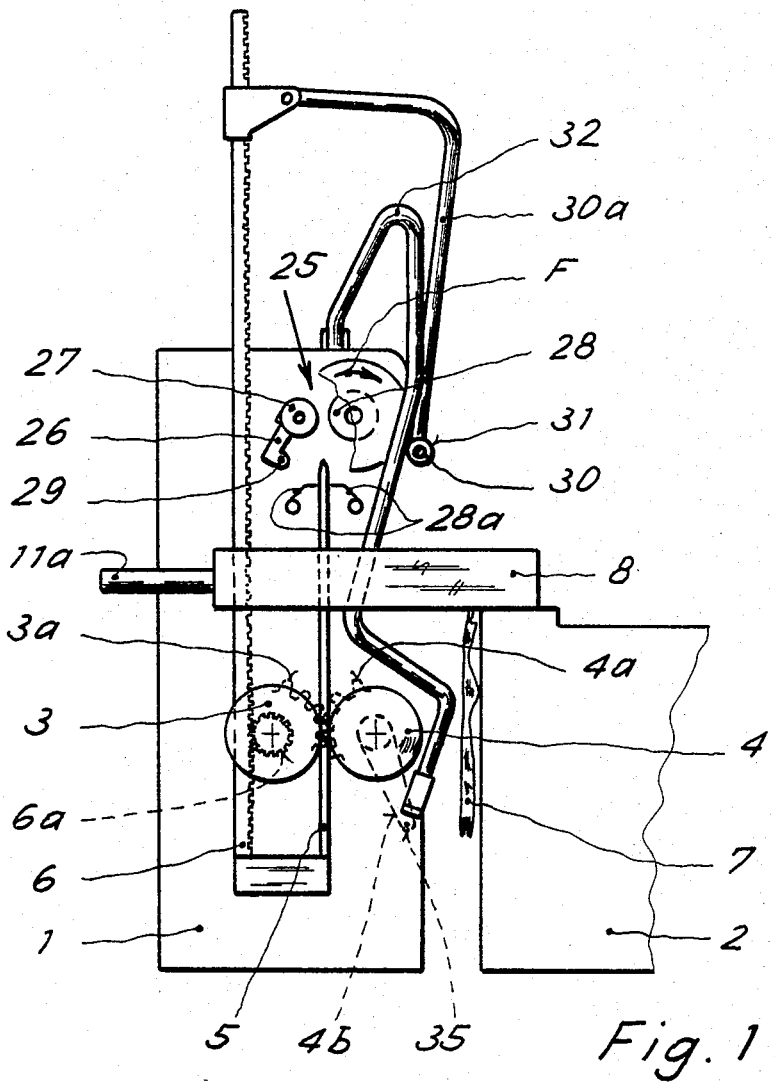
FIG. 1 is a general elevational view of a preferred apparatus according to the present invention.

As shown in FIG. 1, the machine for automatically reversing or turning hose inside out comprises a frame 1 adjacent to a sewing machine 2 of the rotating type or of any other known type, which is equipped with two rollers 3 and 4, having suitably knurled surfaces and rotatable about substantially parallel horizontal axes contained in a common horizontal plane. The rollers 3 and 4 are contra-rotatable by mechanisms 3*a* and 4*a* partially shown in the figure, to which they are coupled and can be rotated at different speeds. A vertically extending rod or round blade element 5 is movable vertically (normal to said horizontal plane) towards and through the nip between the rollers 3 and 4 by means of a rack 6 connected thereto and controlled by a cog wheel 6*a*, keyed to the same shaft as the roller 3, as better shown in FIG. 4.

The roller 4 is mounted on a layer 4*b* pivoted at 35 and urged towards the roller 3 by resilient means (not shown) to form a nip between the rollers.

Figure 2:
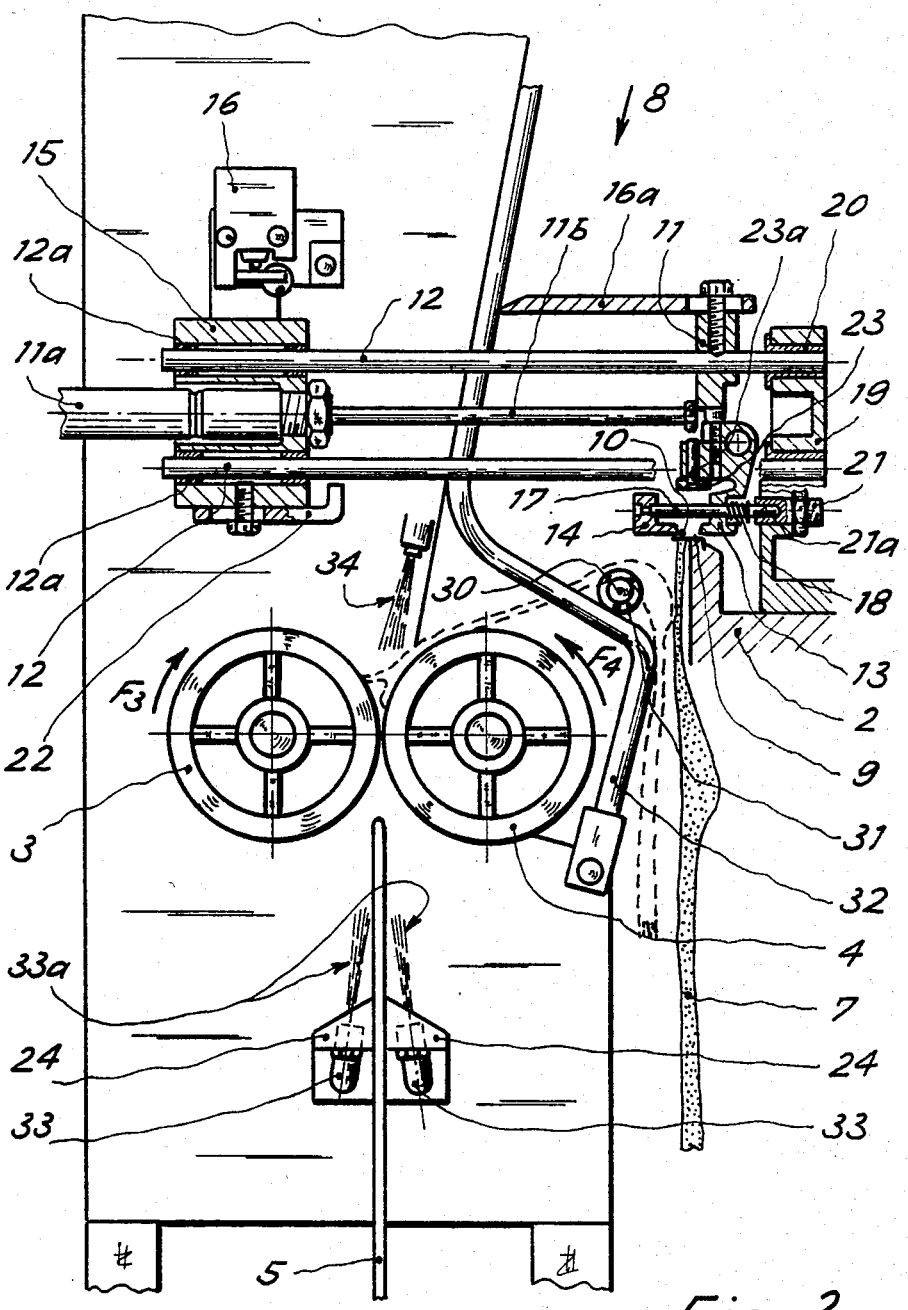
FIG. 2 is a partial cross-section of the apparatus of FIG. 1 seen from one side, illustrating a detail of the pick-up and conveyor assembly.

FIG. 2 shows the sewing machine 2 with a hose 7 arranged over needles 9 at a point where, at this stage of the manufacturing process a seam 10 has already been made by the sewing machine 2.

Figure 3:
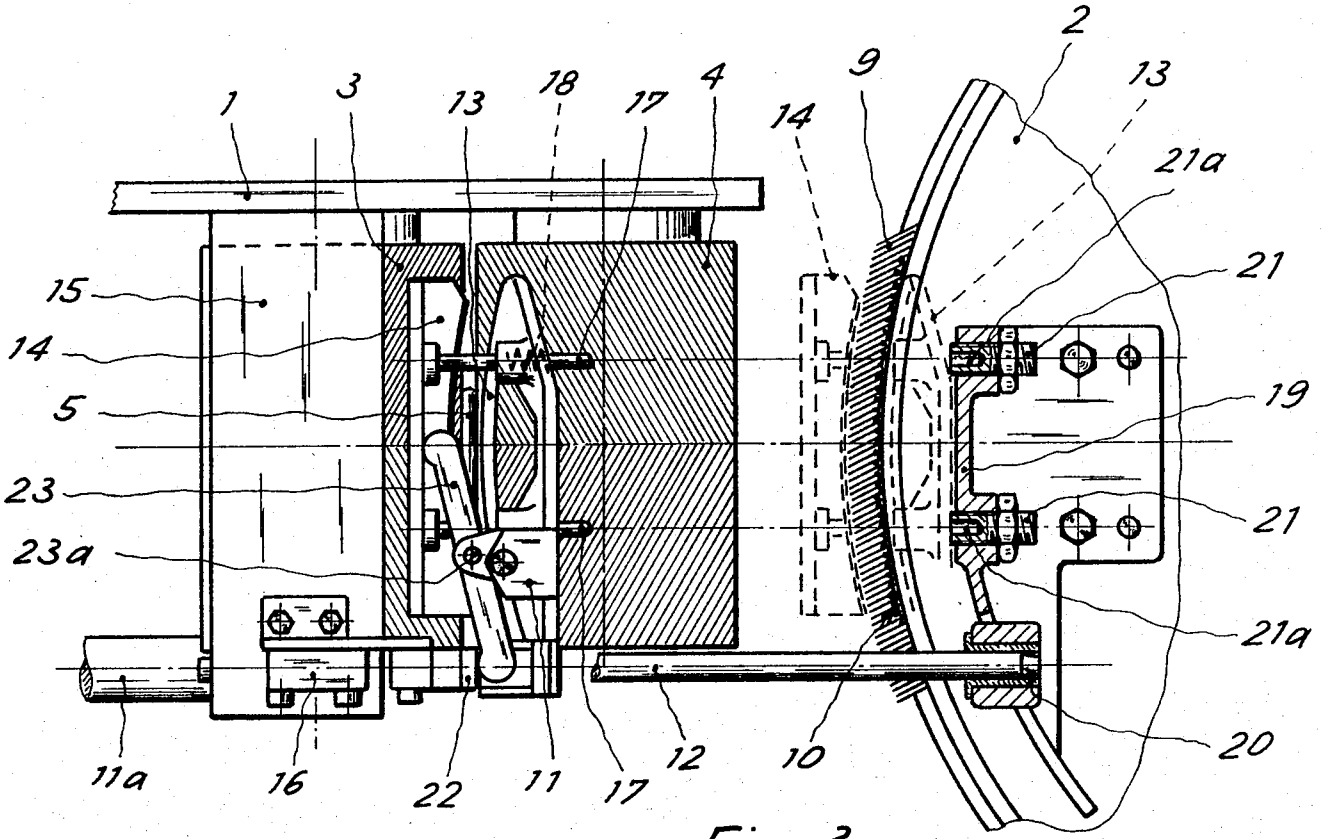
FIG. 3 is a view from above of the apparatus of FIG. 2.

A pick-up and conveyor member 8 (FIGS. 2 and 3) comprises a slide 11 operated by a cylinder 11*a* having a shaft 11*b*, displaceable into and out of the cylinder 11*a*, guide rods 12 and respective fixed and movable jaws 13 and 14, which are shaped to match the terminal outline of the sewing machine 2, as can be better seen in FIG. 3. The jaws 13 and 14 are arranged to engage the closed end of the hose 7 and to transport the supported hose towards the cylinder 11*a* as the shaft 11*b* is retracted thereinto.

The guide rods 12 slide in respective seats 12*a* of a support 15 which carries the cylinder 11*a* and which also carries an end of run switch 6 operated by a bar 16*a* mounted on the slide 11.

The movable jaw 14 is supported and axially guided by rods 17 equipped with springs 18 projecting on the fixed jaw 13. The sewing machine 2 has a terminal block 19 having guide bushes 20 for the rods 12 and adjustable stop members 21 with holes 21*a* for the insertion of the guide rods 17.

The support 15 carries a step member 22 and the slide 11 carries a lever 23 which is rotatable about a pivot intermediate its length provided by a pin 23*a* carried on the slide 11. When the slide 11 is displaced away from the sewing machine 2 towards the support 15, and when the closed end of the hose between the jaws 13 and 14 is above the nip between the roller 3 and 4, one end of the lever 23 engages the stop member 22 causing the lever 23 to pivot and the other end of the lever to urge the jaw 14 away from the fixed jaw 13 and release the closed end of the hose.

The closed end of the hose 7 drops towards the nip between the rollers 3 and 4 and the latter tend to urge this closed end into the nip. The rod or blade element 5 during its vertical displacement is guided by guide blocks 24. A take-off assembly 25 is provided towards the upper end of the travel of the rod or blade element 5 and comprises a lever 26 carrying a roller 27, covered with rubber or similar material, and a roller 28 which is also covered with rubber or similar material and which rotates in the direction indicated by arrow F by means of a motor (not shown) (see FIG. 1).

The lever 26 can rotate about a pin 29 and is kept abutting against the roller 28 and the rod or blade 5 when the latter has completed its ascending movement by means of a spring or similar resilient part (not shown).

Below the rollers 27 and 28 friction members 28*a* are provided consisting, for example, of a pair of resilient sheet metal plates, as shown in FIG. 1, or of other parts resiliently pressed against the rod or blade 5 towards the upper end of its travel.

A bar 30 which extends horizontally and substantially parallel to the axes of rotation of the rollers 3 and 4 is located in the path of travel of the hose 7 as it is transported away from the sewing machine 2 by the jaws 13 and 14. As the hose 7 is so transported it is engaged intermediate its length by the bar 30 so that the engaged closed end thereof leads during such transportation and is not impeded when released to drop towards the nip between the rollers 3 and 4. Also, when the closed end is released a sufficient part of the length of the hose drops onto the roller 4 to cause the latter to advance the hose towards the nip. The bar 30 is connected to the rack 6 by a bar 30*a* which extends upwardly and is pivotally connected to the rack 6 so as to be capable of pivoting about a horizontal axes. The bar 30 carries a roller 31 which is urged into engagement with a profiled guide bar 32 secured to the frame 1 so that the bar 30 is displaced in synchronism with the rack 6 and, at the same time, is caused to follow a predetermined path defined by the profile of the guide bar 32 so that the hose 7 draped over the bar 30 is presented to the nip between the rollers 3 and 4 at an optimum altitude to enable it to slide over the rod or blade 5.

The blocks 24 acting as sliding guides for the rod or blade 5 carry nozzles 33, directed from below towards the nip of the rollers 3 and 4, towards which the tow cap or closed end of the hose is released and they are able to release jets of air 33*a* intended to open or form a depression in the end of the toe cap. Further jets 34 are located above rollers 3 and 4 and operable to direct jets of air towards the nip of the rollers to make it easier for the hose to be correctly located between the rollers and to ensure that the toe cap of the hose is opened sufficiently widely or is formed with sufficiently large depression to receive the leading end of the rod or blade 5 which, at that moment, is in the nip between the two rollers 3 and 4.

The machine operates as follows:

After the toe cap seam 10 has been made, the sewing machine 2 takes the hose 7 to a position at which the seam 10 is disposed between the jaws 13 and 14 of the pick-up member 8 which is in the position shown in full lines in FIG. 2. The slide 11 is then displaced away from the sewing machine 2 towards the rollers 3 and 4 of the cylinder 11*a* by retracting the rod 11*b*, whereby the jaw 13 moves towards jaw 14 to grip the seam 10 therebetween. As the motion of the slide 11 continues, the pins 17 are extracted from the stop members 21 and the rods 12 from the supports 20, so as to allow the pick-up member 8 to reach its other end position, indicated by a broken line in FIG. 2 and by full lines in FIG. 3. Throughout this displacement, the hose 7, gripped by its seam 10, is transported towards the rollers 3 and 4, and is engaged intermediate its length against the transverse bar 30 until the lever 23 meets the stop member 22 and is pivoted to displace the jaw 14, moving it away from the jaw 13, thus releasing the toe part of the hose 7. Consequently, the hose falls on to the roller 4 with its end arranged in the nip between the rollers 3 and 4, while the upper jets of air 34 push the toe part into the nip, opening it up in a direction parallel to the shafts of the rollers as shown by a broken line in FIG. 2.

Subsequently, when the hose has been firmly gripped by the rollers 3 and 4 and before the toe cap meets the rod or blade element 5, the lower jets of air 33*a*, directed towards the gap between the rollers 3 and 4, tend to open the end of the toe cap of the hose making it easy for the rod or blade element 5 to engage the end of the hose and push it into the general body of the hose.

Figure 4:
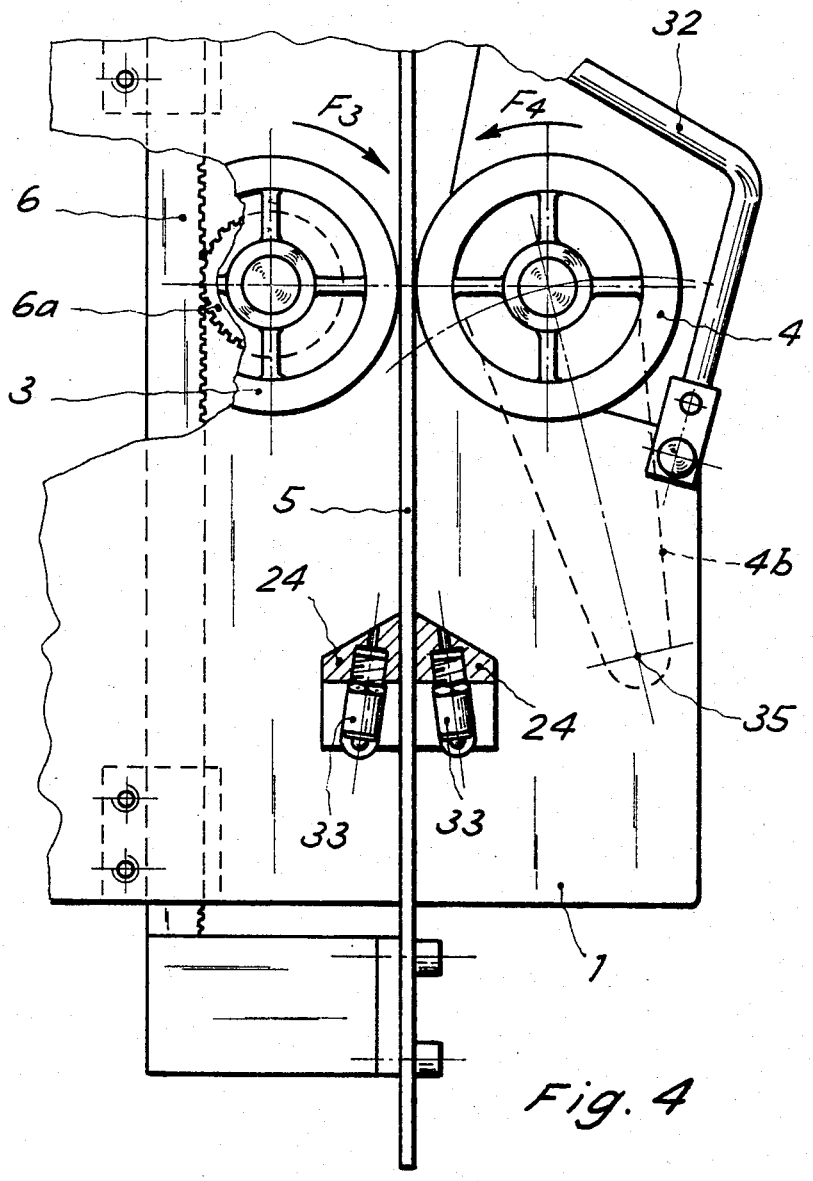
FIG. 4 is an enlarged view illustrating a detail of the operation of the rod or blade element and the horizontal rollers.

At this time, the rollers 3 and 4 contra-rotating downwardly in the direction of the arrows F3 and F4 are started, and the roller 3 moves conveniently at a higher speed than roller 4 in order to make up for the different path development caused by the curvature of the hose and by the possible existence of a heel bag and the blade 5 is also moved, but in an upward direction, by the cog wheel 6*a* integral with the roller 3 and engaging in the rack 6 integral with rod or blade 5 (see FIG. 4).

As a result of all these movements, the tip or leading end of the rod or blade 5 is inserted between the two sides of the toe cap of the hose 7, which were opened by jets 33*a* when the hose 7 is held between the rollers 3 and 4, the roller 4 being resiliently pressed against the roller 3 and hence against the rod or blade 5 as previously mentioned.

Since the rollers 3 and 4 move downwardly and the blade 5 upwardly, once the tip of the blade 5 has been inserted in the toe cap of the hose, the tubular part of the hose 7 is pulled downwards by friction against the rollers 3 and 4 when blade 5 goes upwards, and it is placed about the rod or blade 5 in a reverse position in relation to the position it had when it was on the sewing machine 2.

Throughout the upward movement of the rod or blade 5, the transverse bar 30, on which the hose 7 rests (see FIG. 2), is lifted by the rack 6 by means of the rod 30*a* while the roller 31, which is in contact with a guide 32, forces the bar 30 to accompany the hose, first towards the vertical contact plane of the rollers 3 and 4, and then upwards in such a way that the hose 7, as it progressively slips over the rod or blade 5, is presented at the best possible altitude to the leading end of the rod or blade 5, making it impossible for the rod or blade 5 to become entangled in the base of the heel or in other parts of the hose. When the rod or blade 5 reaches the end of its upward journey, the hose 7 is turned inside out on the rod or blade 5 and the toe cap has moved between the rollers 27 and 28, which are resiliently urged towards one another and which rotate upwards.

These rollers 27 and 28 grip the end of the hose carried by the rod or blade 5 and gradually take it off the rod or blade, as the latter is lowered by the action of the reversed rotation of the rollers 3 and 4 with the downward movement of the rack 6.

Throughout the movement for taking the hose 7 off the rod or blade 5 the friction members 28*a* act on the end part of the hose which may not have been completely reversed in the case of long hose and carry the reversal operation to its completion.

It is therefore also possible for hose having a considerable length to be reversed, even if the rod or blade element used is of limited length, possibly shorter than the overall length of the hose to be reversed.

Hose which is taken off the rod or blade 5 by the rollers 27 and 28 is directed towards a side exit, for instance by means of a diverter, a jet of air, or by using different diameters for the contact rollers 27 and 28 or other similar elements, as is the case in the embodiment of FIG. 1, thus allowing the hose to be correctly oriented to fall into a collection station, not shown.

It must be understood that many variants may be introduced to the above description, especially with respect to the sewing machine with which the subject of the present invention is associated, as it is possible for the machine to be of a known type, for instance rectangular rather than circular, or to be equipped with different sewing means etc., and it is equally possible to control the movements of the rollers, of the rod or blade and of the bars by other known means, provided that they are synchronised with each other, without departing from the scope of the present invention.

We claim:

1. Apparatus for turning hose inside out after a seaming operation to form a closed end in the hose comprising a pair of contra-rotatable rollers urged towards each other to form a nip therebetween, transport means engageable with said closed end of the hose and operable to present said closed end to said nip, a rod displaceable through said nip to engage said presented closed end, roller rotating means operable to contra-rotate said rollers in the sense to draw said presented closed end and said hose into said nip, rod displacing means operable in synchronism with said roller rotating means to enter said rod into said nip as said closed end is drawn into said nip and to advance said rod through said nip in engagement with said closed end to displace said closed end away from said rollers as said rollers continue to draw said hose into said nip and about said rod.

2. Apparatus according to claim 1 including take-off means operable to remove said hose from said rod at the termination of the displacement of said rod through said nip and conveying means operable to convey the removed hose to a collecting station.

3. Apparatus according to claim 2 in which said take-off means comprises a further pair of rotatable rollers urged towards each other and disposed in the path of said rod to engage the hose disposed about said rod and take off said hose from said rod.

4. Apparatus according to claim 3 including a pair of friction elements disposed between said pair of contra-rotatable rollers and said further pair of rollers and disposed one on either side of the path of said rod resiliently and frictionally to engage said hose disposed about said rod to complete said turning inside out of said hose as said hose is taken off said rod by said further pair of rollers.

5. Apparatus according to claim 1 in which said rod displacing means includes a rack coupled to said roller rotating means.

6. Apparatus according to claim 1 including a first air jet associated with said transport means and operable to guide said closed end towards said nip and a second air jet directed towards said nip and operable to deform said closed end presented to said nip to facilitate engagement with said rod.

7. Apparatus according to claim 1 in which said transport means comprises a pair of releasable jaws operable to engage said closed end to transport said closed end to a location above said nip, and release means operable to release said jaws and disengage said closed end therefrom at said location.

8. Apparatus according to claim 7 including a guide rod operable to engage said hose during transportation of said closed end to said location such that said closed end leads said hose during such transportation.

9. Apparatus according to claim 8 including guide means operable to guide said guide rod along a predetermined path and guide rod displacing means operable in synchronism with said roller rotating means and said rod displacing means.

10. Apparatus according to claim 1 in which said rollers are contra-rotatable about substantially horizontal axes contained in a common horizontal plane, said rod is displaceable in a direction normal to said horizontal plane and said transport means comprises a pair of releasable jaws operable to engage said closed end with said hose suspended therefrom to transport said closed end to a location above said nip and to release said closed end at said location to present said closed end to said nip.

11. Apparatus according to claim 10 in which said transport means includes a slide carrying said jaws and displaceable between a pick-up location and said location above said nip and a lever pivotally carried on said slide and operable to release said jaws and in which an abutment is provided at said location above said nip engageable by said lever to pivot said lever and release said jaws.

12. Apparatus according to claim 10 in which said rod displacing means comprises a rack driven by said roller rotating means and in which guide means is provided to engage said suspended hose as said closed end is supported to said location above said nip to cause said closed end to lead said suspended hose during such transportation, said guide means being connected to said rack to follow a predetermined path.

13. Apparatus for turning hose inside out after a seaming operation to form a closed end in the hose comprising a pair of relatively displaceable jaws operable to grip said closed end and support said hose, a pair of contra-rotatable rollers urged towards each other to provide a nip therebetween, transporting means operable to displace said jaws and said gripped closed end to a location above said nip, deflecting means disposed in the path of said hose and operable during displacement of said jaws with said gripped closed end to engage said hose intermediate the length thereof and hold said hose to one side of a line between said location and said nip, release means operable to actuate at least one of said jaws to release said closed end at said location and allow it to fall into said nip, a rod mounted below said nip and displaceable upwardly through said nip to engage and carry said closed end, displacing means operable to displace said rod upwardly through said nip from an initial position and to return said rod to said initial position and means for rotating said rollers in a direction to advance said hose downwardly through said nip as said rod carries said closed end upwardly thereby turning said hose inside out.

14. Apparatus for turning hose inside out after a seaming operation to form a closed toe cap end in the hose comprising a pair of jaws displaceable relative to each other to engage said closed toe cap end of the hose and support the hose, transporting means for transporting the jaws with the engaged toe cap end to a hose reversing station, a pair of contra-rotatable rollers disposed below said hose reversing station and urged towards each other to provide a nip therebetween, a rod disposed below the nip of said rollers and displaceable through the nip between said rollers, release means operable to displace said jaws apart at said hose reversing station to release said toe cap end to the nip between said rollers, displacing means operable to displace said rod through the nip between said rollers to engage said released toe cap end, driving means for rotating said rollers to draw said hose into said nip in a direction opposite to the direction of displacement of said rod through the nip between said rollers whereby the displacement of the rod with the engaged toe cap end turns the hose inside out and means for engaging and supporting the hose turned inside out when the rod is withdrawn through the nip between said rollers.

* * * * *